US005974709A

United States Patent [19]

Johnson

[11] Patent Number: 5,974,709

[45] **Date of Patent: *Nov. 2, 1999**

[54] DISPLAY APPARATUS

[75] Inventor: David Brian Johnson, Rickmansworth, United Kingdom

[73] Assignee: I.D. Cassette Limited, United Kingdom

[ * ] Notice: This patent issued on a continued prosecution application filed under 37 CFR 1.53(d), and is subject to the twenty year patent term provisions of 35 U.S.C. 154(a)(2).

[21] Appl. No.: 08/702,657

[22] PCT Filed: Mar. 8, 1995

[86] PCT No.: PCT/GB95/00499

§ 371 Date: Sep. 6, 1996

§ 102(e) Date: Sep. 6, 1996

[87] PCT Pub. No.: WO95/24711

PCT Pub. Date: Sep. 14, 1995

[30] Foreign Application Priority Data

Mar. 9, 1994 [GB] United Kingdom ..... 9404553

[51] Int. Cl.[6] ..... G09F 11/00

[52] U.S. Cl. ..... 40/490; 40/488

[58] Field of Search ..... 40/476, 488, 490, 40/491

[56] References Cited

U.S. PATENT DOCUMENTS

| | | | |
|---|---|---|---|
| 2,141,398 | 12/1938 | Loewenstein . | |
| 3,080,668 | 3/1963 | Reali . | |
| 3,403,465 | 10/1968 | Lane . | |
| 3,421,240 | 1/1969 | Bardi . | |
| 3,430,371 | 3/1969 | Phillips | 40/486 |
| 3,430,372 | 3/1969 | Rutchick | 40/486 |
| 3,659,367 | 5/1972 | Yamoto . | |
| 4,102,068 | 7/1978 | Rutchik | 40/491 |
| 4,489,514 | 12/1984 | Honse . | |
| 4,759,141 | 7/1988 | Aoyagi | 40/488 |
| 4,783,923 | 11/1988 | Grinwald et al. . | |
| 5,551,905 | 9/1996 | Billings et al. | 40/491 X |

FOREIGN PATENT DOCUMENTS

| | | |
|---|---|---|
| 2626100 | 7/1989 | France . |
| 2194374 | 3/1988 | United Kingdom . |
| WO8302517 | 7/1983 | WIPO . |

*Primary Examiner*—Brian K. Green
*Attorney, Agent, or Firm*—Christie, Parker & Hale, LLP

[57] ABSTRACT

A display apparatus has an interchangeable cassette including a first static image-bearing slatted panel and at least two further movable image-bearing slatted panels, movable relative to the static panel and interleaved therewith. The panels form part of the cassette in which any of the panels can be selectively removed and replaced. Additionally, the display apparatus includes a frame for receiving the cassette. The frame includes a drive system for selectively moving the movable panels to enable the slats on each of the movable panels to move from a position behind the slats of the static panel, to a position in front of the slats of the static panel, thereby enabling an image on the panels to be viewed.

26 Claims, 9 Drawing Sheets

Fig.12. PROGRAMMABLE CYCLE TIME VARIABLE

| | T1 | T2 | T3 | T4 | TOTAL |
|---|---|---|---|---|---|
| * ○ ○ MODE A | 6 | 6 | 6 | 6 | 24 |
| ⊘ ○ MODE B | 5 | 5 | 5 | 9 | 24 |
| ○ ⊘ MODE C | 4 | 4 | 4 | 12 | 24 |
| ⊘ ⊘ MODE D | 3 | 3 | 3 | 15 | 24 |

* AS ILLUSTRATED BELOW

DISPLAY APPARATUS

BACKGROUND OF THE INVENTION

This invention relates to a display apparatus. In particular, it relates to a display apparatus capable of sequentially displaying a plurality of static images, such as advertising images.

Display apparatus of this type is extensively used in advertising, especially at the point of sale or on billboards for example. A typical prior art example of an advertising medium capable of presenting more than one image sequentially comprises an array of elongate elements which are triangular in cross-section. Parts of the whole image are provided on each of the elongate faces so that when one set of these face outward a viewer can see an entire image disposed across all the faces. After a time period, each of the element rotates about its longitudinal axis to bring another face forward to view a second image. Such a system therefore enables three different images to be viewed, each for a predetermined period of time.

Such devices are, however, bulky and have a large depth because of the depth required by the triangular section pieces. Also, since advertisements are changed and updated regularly, it can be difficult to change an advertisement since this requires altering the image on each of the three faces on each of the triangular pieces. This can be very time consuming where a large number of triangular pieces are provided to form each image. For example, twenty separate triangular pieces may be laid continuously to form a single image.

Attempts have been made to reduce the complexity of such devices and to overcome the complexity of rotating members by using planar sheets. Examples of these are shown in U.S. Pat. Nos. 2,141,393, 3,403,465, 3,421,240 and 3,659,367. Each of these relates to a changeable display structure comprising a plurality of slatted sheets which are interleaved such that relative sliding movement causes images to be selectively exposed to view. Often, as in U.S. Pat. Nos. 2,141,398 and 3,659,367 these devices are intended for manual manipulation and are therefore of limited use. Attempts to drive the sheets, by means such as motors, have often tended to complicate their structure, as in U.S. Pat. No. 3,421,240. Also, in prior art devices it has generally been difficult or time consuming to change messages. Training, and therefore skilled personnel, is often required to change the messages displayed.

SUMMARY OF THE INVENTION

An object of the present invention is to provide an improved display means which enables the messages displayed to be easily and simply changed by unskilled personnel in a short amount of time.

According to the present invention there is provided a display apparatus comprising an interchangeable cassette including a first static image-bearing slatted panel, at least two further image-bearing slatted panels, each movable relative to the first slatted panel and interleaved therewith, the three or more slatted sheets forming part of a cassette in which any of the sheets can be selectively removed and replaced, and a frame for receiving the cassette comprising a drive means having means for selectively moving the sheets other than the first one to enable the slats on each of the movable sheets to move from a position behind the slats of the first sheet, to a position in front of the slats of the first sheet, to thereby enable the image on the sheet to be viewed.

Preferably the frame includes the drive means on a rear portion thereof. A front frame portion may be provided which can detachably connect to the cassette to detachably secure the cassette within the frame. The cassette may alternatively or in addition be located by one or more pins and cooperating locating holes and sockets on the frame and cassette.

Preferably, the drive means comprises a plurality of pins driven by means such as solenoids and the moveable sneers comprise holes and slots, the holes in one sheet being in register with the slots of other sheets such that each pin can enter a hole in one sheet only to move only that sheet, the pin moving within the slots of the other sheets so that these sheets are not moved by that pin.

The drive means may also be operated and controlled remotely. The device may be used as a trilingual (or more) directional sign for example.

According to the present invention there is further provided a removable cassette for a display apparatus, comprising a front panel, a rear panel, a static image-bearing slatted panel and at least one image-bearing slatted panel, movable with respect to the static panel and interleaved therewith, the image-bearing panels being sandwiched between the front and rear panels.

BRIEF DESCRIPTION OF THE DRAWINGS

Embodiments of the invention will now be described, by way of example only, with reference to the accompanying drawings, in which:

FIG. 8 shows a sequence in which the sheets may be relatively moved to present different images to a viewer;

FIGS. 12 and 13 show timing diagrams;

DETAILED DESCRIPTION OF THE INVENTION

Referring to the Figures, a display apparatus comprises a frame having a rear panel and a front panel. A removable exchangeable cassette can be placed within the frame, which cassette comprises means for displaying a respective series of images. These may be advertising images and the apparatus may be placed at a point of sale for example.

An interchangeable cassette comprises a rear panel 50 (FIG. 2), three or more image bearing panels (of which four are shown in FIGS. 3 to 6) and a front panel 23 (FIG. 1) bearing a window 22 through which respective images of the image panels may be seen.

Figure 1:
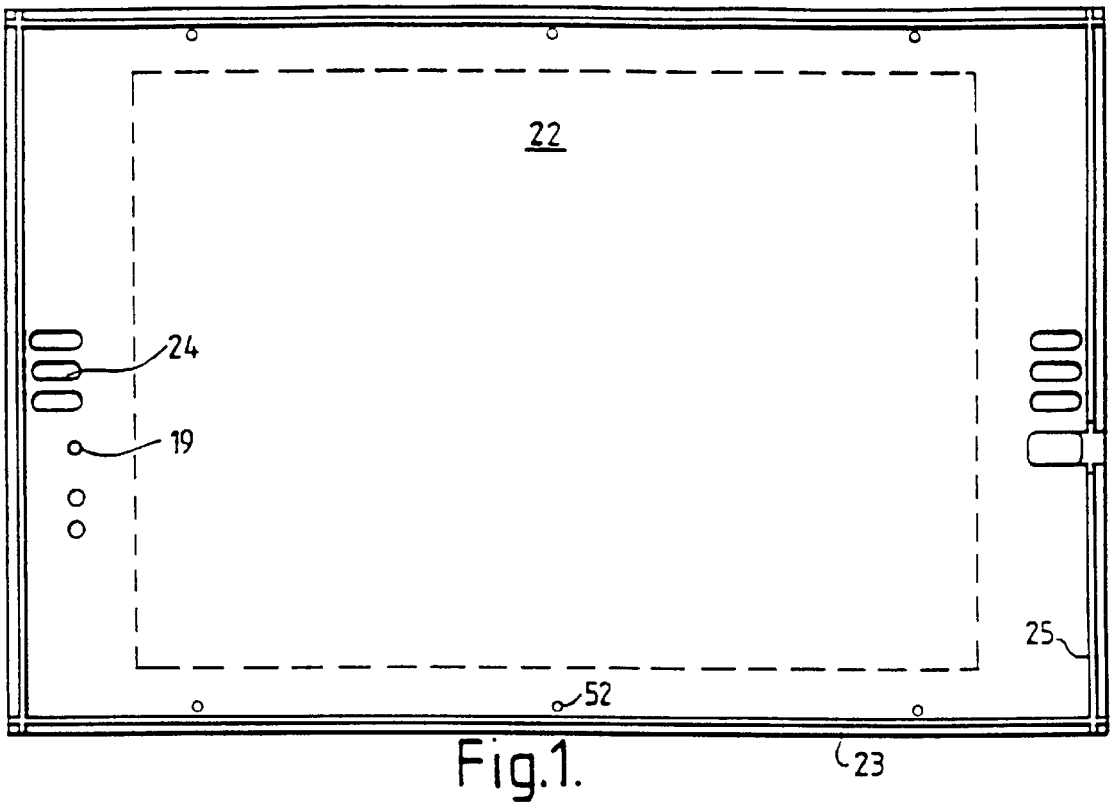
FIG. 1 shows a front panel of a cassette.
Figure 2:
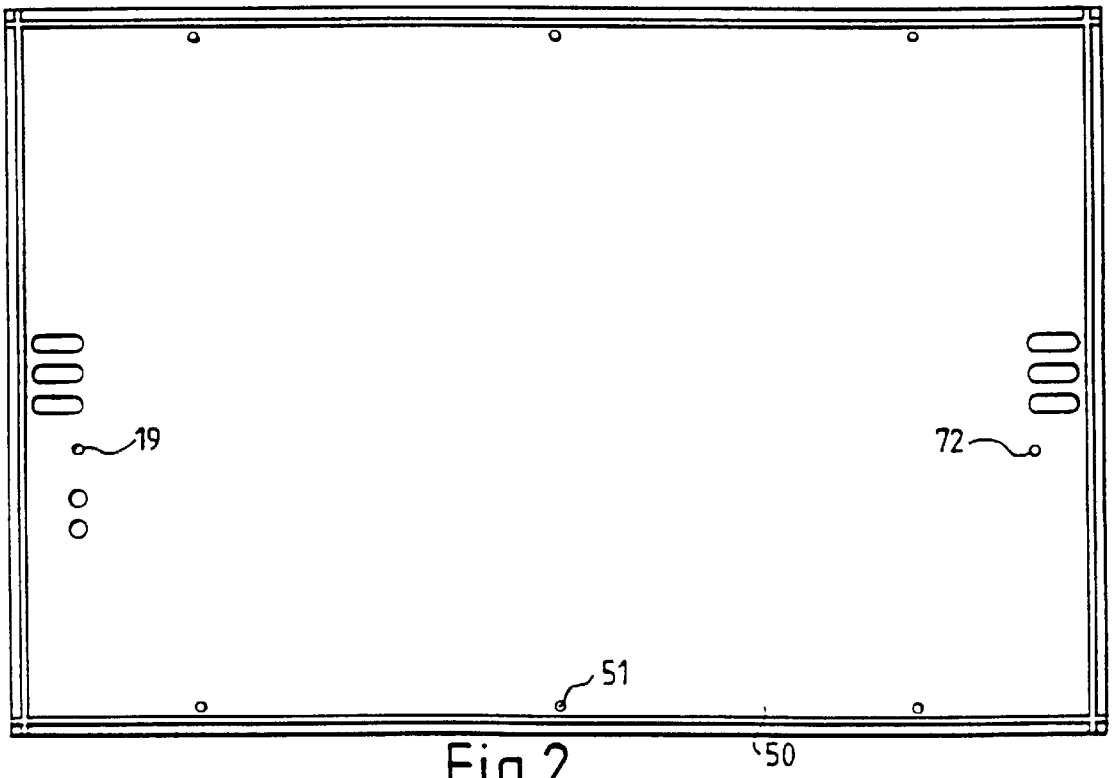
FIG. 2 shows a rear panel of a cassette.
Figure 3:
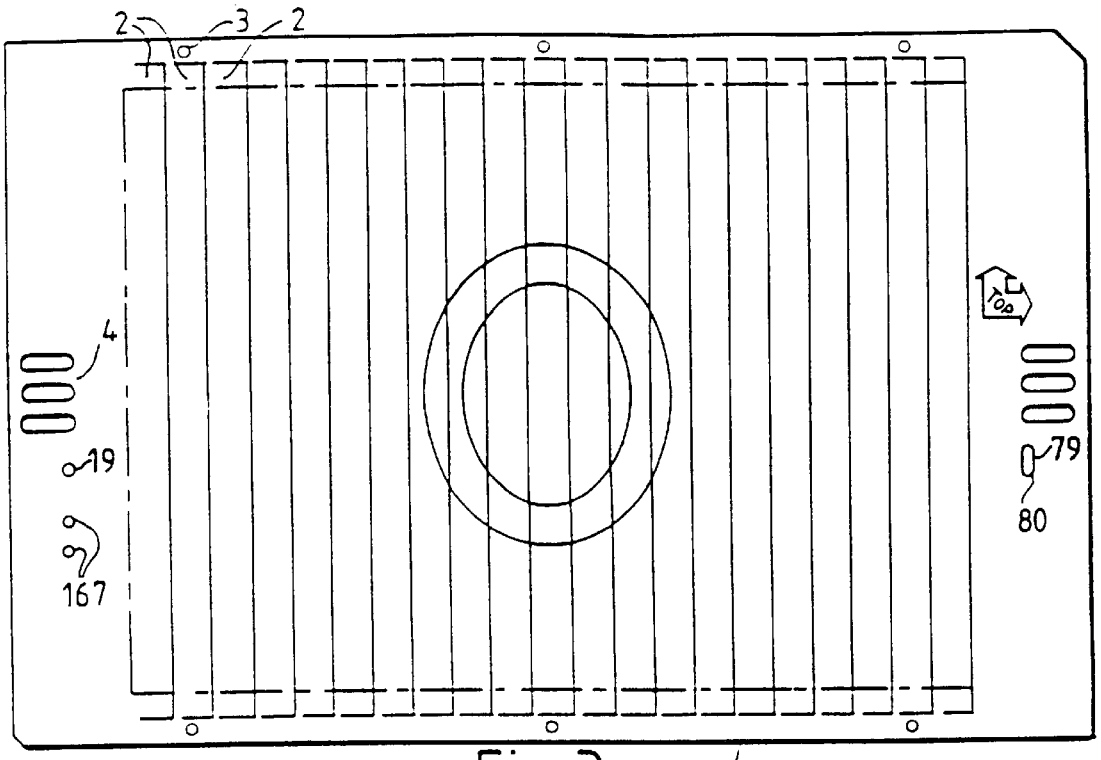
FIGS. 3, 4, 5 and 6 show slatted sheets forming part of a cassette and bearing respective first to fourth images.

The image bearing panels comprise a first static panel shown in FIG. 3. This panel 1 is formed from a thin sheet of a material such as a plastic, paper or board material which is cut to form a plurality of parallel slats 2. An image is formed across the slats so that when viewed from the front the image appears to be complete. In FIG. 1, the image is a large 0 (zero). More typically, the image would of course be advertising or other material. The shaded area of the image plates shows the area of the plate viewed through the window of the front plate. In this example, twenty slatted portions are provided. Six through-holes 3 are formed in the upper and lower parts of the sheet, which act as locating holes for fitting over pins on the back panel of the cassette. A plurality of slots 4 are also provided at each end of the sheet. The number of slots is dependent on the number of images which are to be portrayed by the cassette. In the example shown, four images are portrayed and therefore three slots are provided at each end. If more than three are to be portrayed, say n images, then n−1 slots will need to be provided at each end of sheet 1. Alternatively, only two or more movable sheets may be provided.

Figure 4:
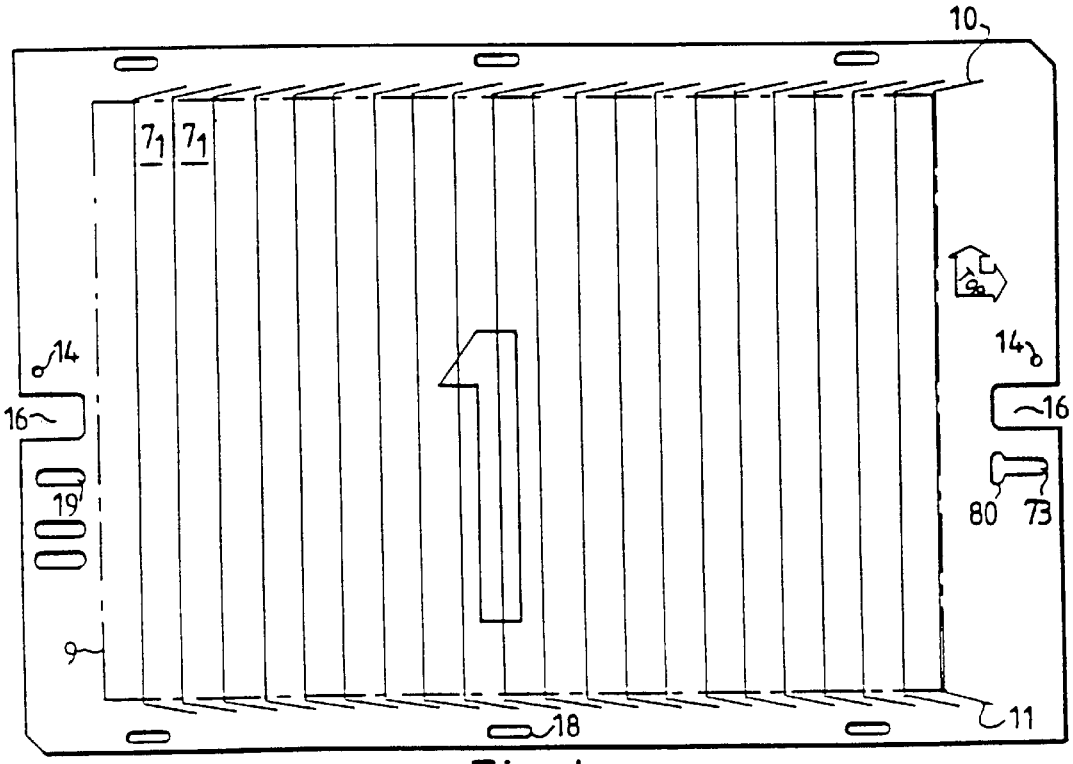
Figure 5:
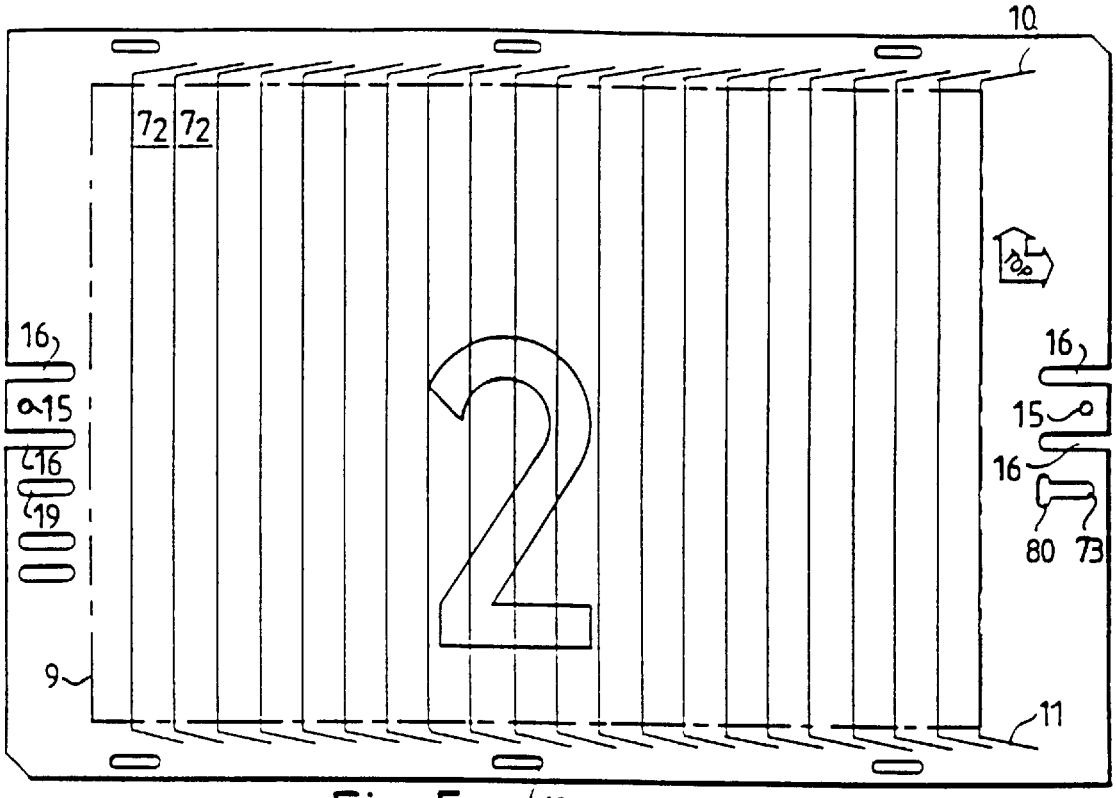
Figure 6:
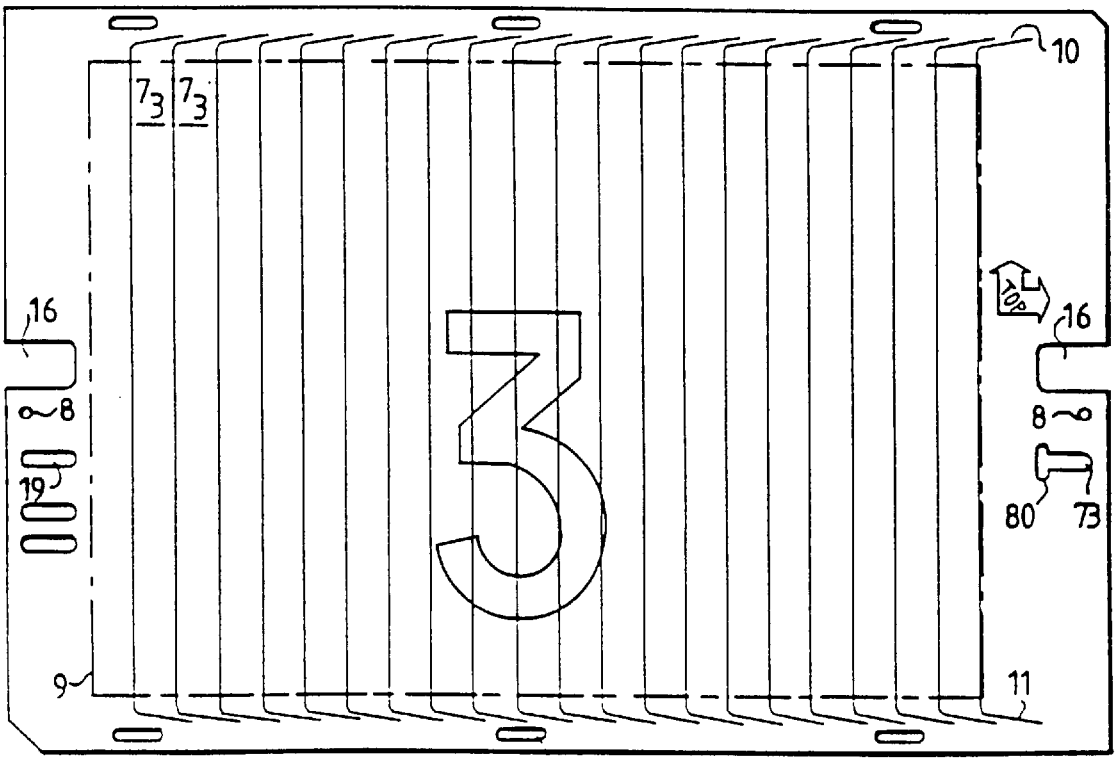

FIGS. 4 to 6 show second, third and fourth sheets, respectively forming part of the cassette bearing images 1, 2 and 3, respectively. These are movable sheets which slide relative to static sheet 1 to present their respective images in front of the image shown by sheet 1. Each of the movable sheets has a plurality (for example twenty) of slatted portions $\mathbf{7}_1$, $\mathbf{7}_2$, $\mathbf{7}_3$. These are each formed by making a plurality of cuts 9 parallel to the sides of the sheets and further cuts 10, 11 from the top and bottom of each cut 9. Each movable panel comprises through holes 14, 14, 15, 15, 8, 8 at each edge for receiving a driving pin to move the respective sheet back and forth with respect to static sheet 1. One or two slots 16 are also provided at each end of each panel, the slots of one panel being positioned so that when the sheets are laid over one another a slot from one sheet lays substantially over the whole of a second panel and vice-versa so that the pin which is received in, say, hole 14 of the first panel moves within the slot 16 of the second and third panels so that when this pin is actuated only the first panel 5 and not the other panels move. Similar holes and slots are formed in the other respective side of each panel.

Clearly, if more or less than three movable panels are provided then there will need to be an increased or decreased number of slots in each panel to accommodate the additional or lesser number of pins necessary.

Figure 7:
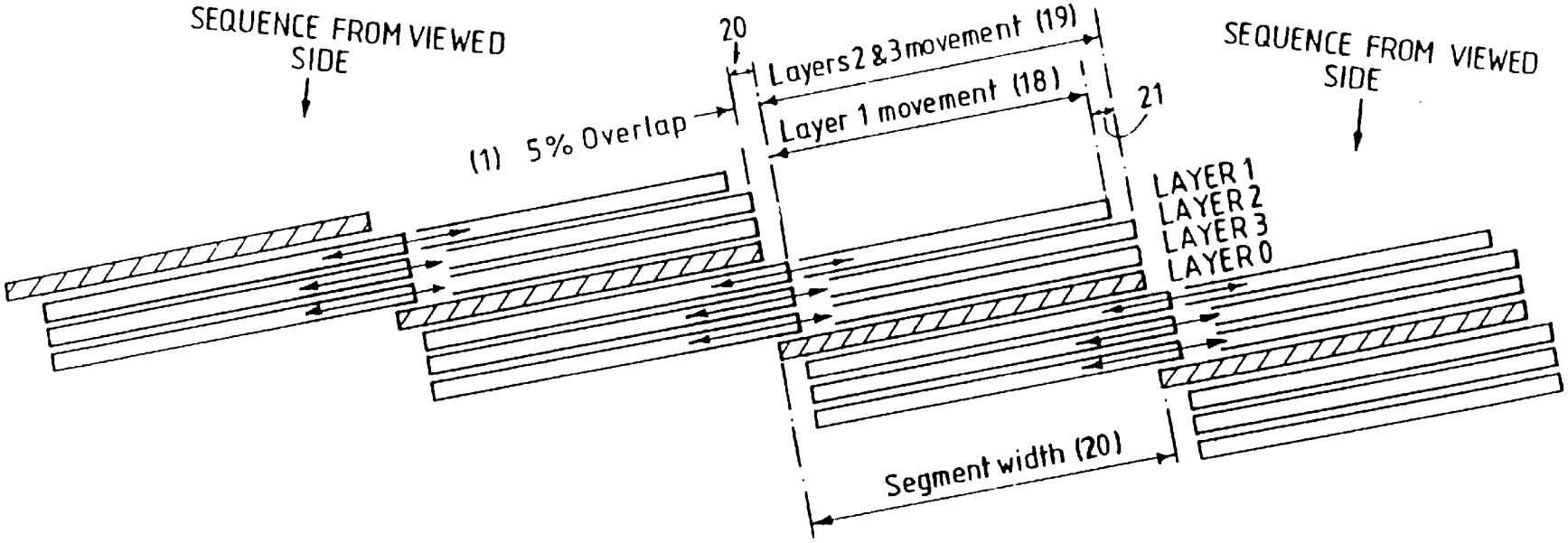
FIG. 7 shows how the slatted sheets of FIGS. 3 to 6 are interassembled.

Further locating slots 18 are provided towards the top and bottom of each of the movable panels through which the locating pins which locate into holes 3 in sheet 1 can protrude. The slots also limit lateral movement, ensuring that the slats remain engaged and do not separate through over-travel. Clearly, in the movable panels these must be slots rather than holes since the panels are movable and space must therefore be allowed for relative movement of the panel and pin. An additional cassette location hole is shown at 19 in each of FIGS. 1 to 6. In the front, rear and static image panels this is a hole while in the movable panels it is of course a slot FIG. 7 shows schematically the interconnection of static panel 1 and the movable panels. In this figure, a number of adjacent slats of each panel are shown. As is shown in the figure, the slats of layer 0 lie at such an angle to each other that the slats of layers 1, 2 and 3 can lie between adjacent slats of layer 0. Layer 1, 2 and 3 are then slidably moved back and forth with respect to layer 0 to bring the image on, respectively, layer 1, layer 2 or layer 3 in front of the image of layer 1 to display that image. Layer 1 is mounted underlying layer 0, layer 2 underlies layer 1 and layer 3 underlies layer 2. Clearly, if an additional movable panel is to be provided, then the slat angles will need to be greater to accommodate the extra depth required between adjacent slats. Alternative, less movable panels will need a smaller angle. More than three movable panels may be provided, but the angles of the slats start to become so large that the image becomes distorted. To minimize this effect, the panels are of a thin material in proportion to the size of the graphics being displayed. Also, distortion effects may be overcome by increasing the slat width, thus reducing the layering angle effect.

The sheets forming the image panels are preferably of a flexible material, and may for example be paper encapsulated in a plastic (e.g. polypropylene) layer. Polypropylene has a low co-efficient of friction, this aids the sliding movement of the panels. Other plastic materials may be used. This may, e.g., be heat shrunk onto the paper. The sheets may be, for example about 200–250 $\mu$m in thickness. The sheets are therefore too thin to have inherent mechanical stability. The stability of the slatted material is achieved in the present invention by the sandwiching effect between the front and back panels of the cassette, enabling the moving panels to slide and preventing them from twisting and becoming disengaged. The front and back panels are therefore of a rigid or relatively rigid material.

To ensure that the slats do not stick or become disengaged when slid backwards and forwards, a degree of overlap is required as shown at 20. The slats of layers 1, 2 and 3 overlap the respective slats of layer 0 by around 5% of their width. Although this does mean that 5% of the image displayed by panel 1 will be obscured, in practice this is insignificant and the overall image quality is not unduly visibly deteriorated. Also, it is desirable to displace the movable panels by different amounts. Thus, layer 7 is displaced by, say, 5% of its slat width less than layers 2 and 3 from its obscured to its visible position. This is shown at 21 which shows the maximum position to which the two panels move. For example, Layer 1 may move by 18 mm each stroke, while layers 2 and 3 move by 19 mm.

Figures 8, 13:
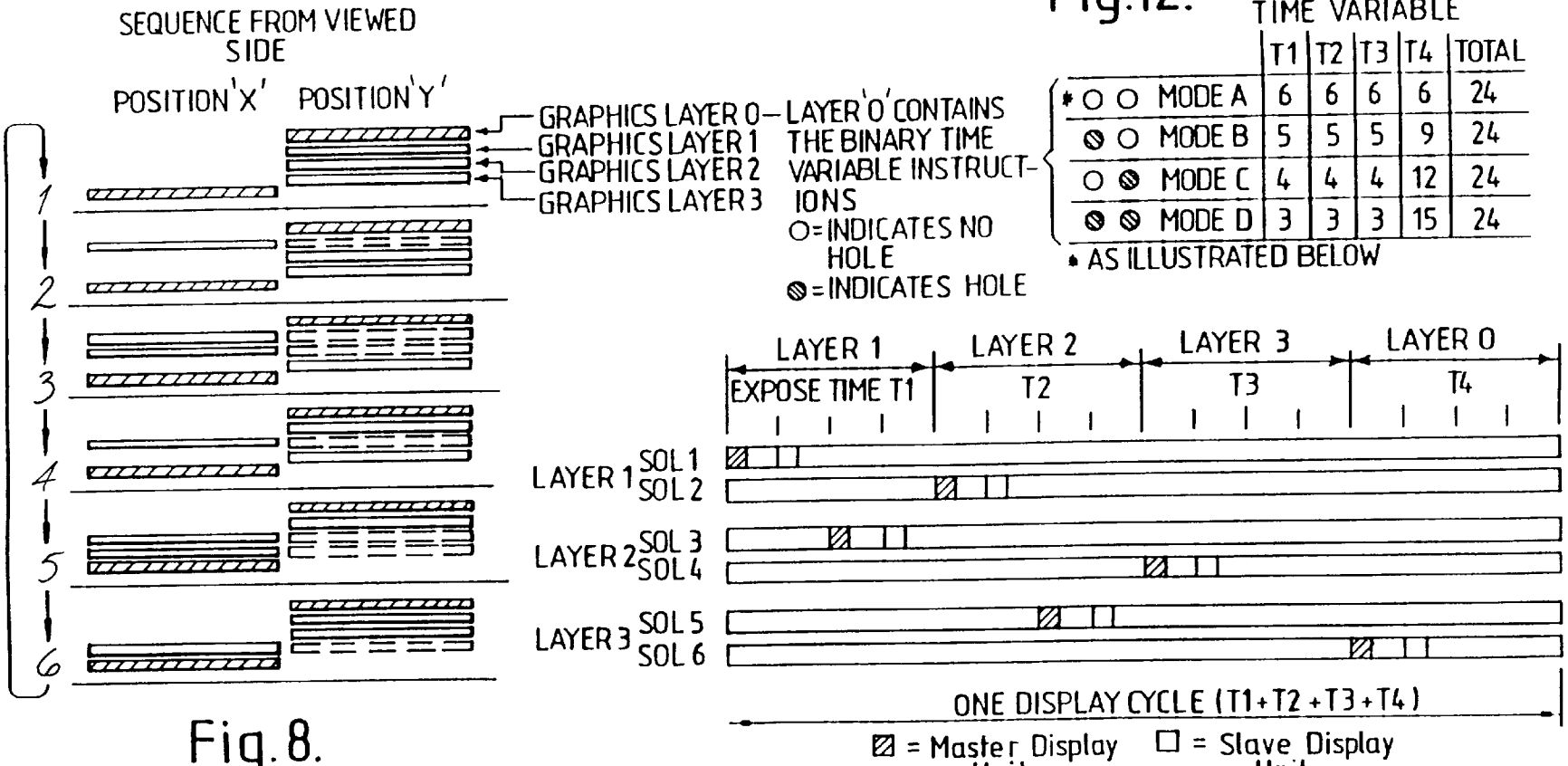

FIG. 8 shows schematically the sequence in which the panels are moved. The figure shows two adjacent interleaved slats of 4 panels. At a first point in time the slats of the movable layers 1, 2 and 3 are obscured behind the slats of static layer 0. Thus, the image on layer 0 is viewed.

Movable panel 1 then moves in front of layer 0. Layer 2 is then moved behind layer 1 (step 3). After layer 1 has been viewed for a predetermined time it is retracted (step 4) revealing layer 2. Layer 3 is then moved behind layer 2 (step 5). After layer 2 has been viewed for a selected time, it is retracted (step 6), revealing layer 3. Finally, again after a selected time internal layer 3 is retracted and step 1 is reached again. The cycle then repeats.

It is found desirable to move layers into position while the image on the previous layer is still being viewed to ensure the smoothest possible changeover and to even out the distribution of power consumption. This reduces the load on the solenoid or other drive-motors caused by excessive power at start-up.

Preferably, the timing is programmable so that the time for which the image on layers 0, 1, 2 and 3 are viewed may differ between each panel. This could be useful if one of the panels bears a message containing a lot of text for example which takes more time to read and to absorb than the other images. Also by making a very quick transition between two or more of the images, a degree of animation can be achieved. This has the advantage of attracting a potential viewer, as sensations of movement are sensed by central or peripheral vision, drawing the viewer to the display.

FIG. 1 shows the front panel 23 of the cassette which incorporates the image panels. The front panel comprises window 22 through which the respective images can be viewed. The window may be of optically polished glass, or a transparent plastic material for example. The frame may be of polycarbonate. The front panel 23 also includes slots 24 at each side, corresponding with the slots such as 16 and through which the driving pins may move. Frame 23 may also include a peripheral locating flange 25 for locating the image panels, as does rear panel 50.

Thus, in use, an interchangeable cassette comprises a rear panel, the four interleaved slatted flexible layer 0 to 3 and a front panel. The front and rear panels are spaced apart by pins such as 51 extending from the rear panel, through holes or slots 18 in the flexible panels and into corresponding blind holes 52 in the front panel.

Figure 9:
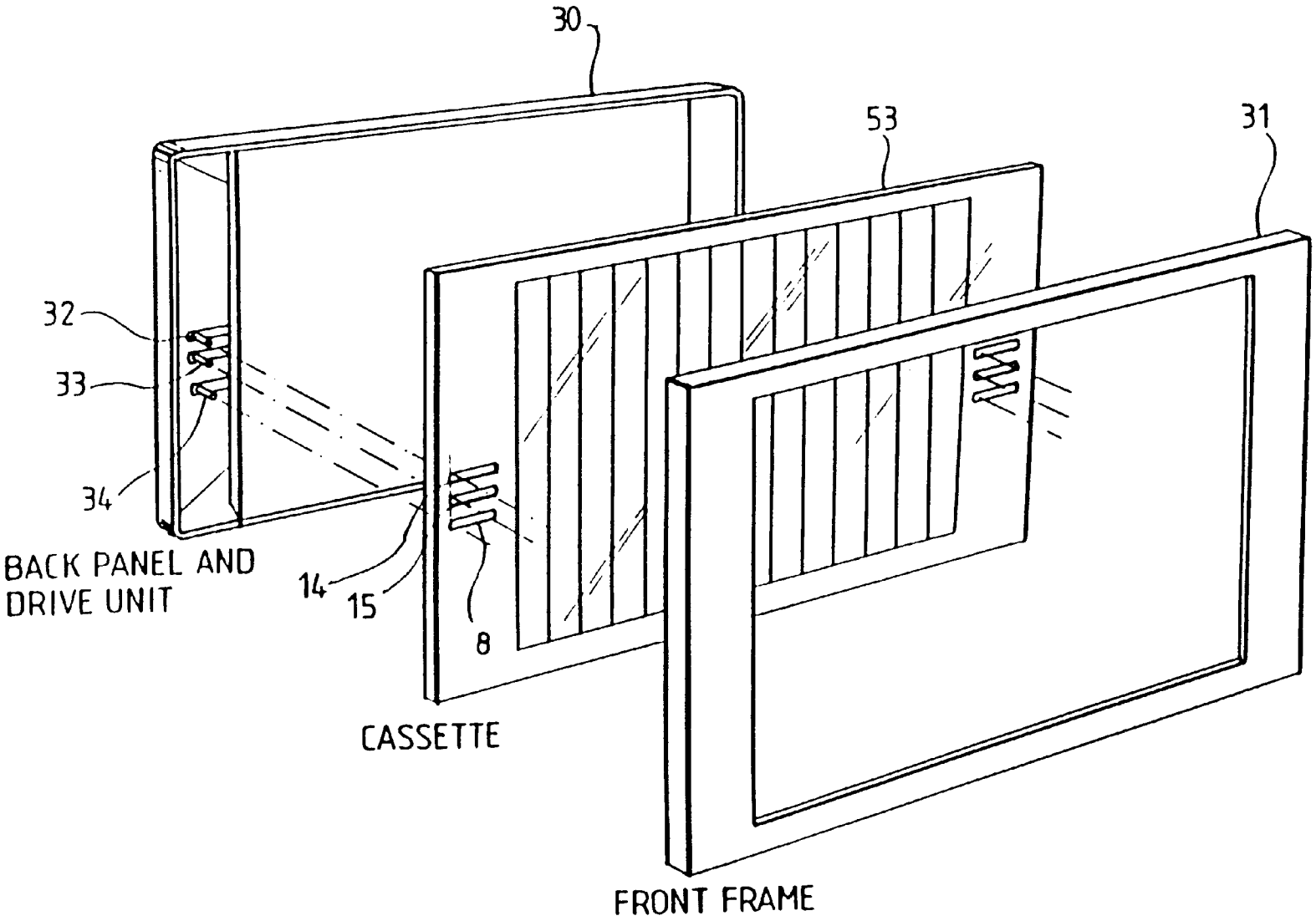
FIG. 9 shows an exploded schematic view of a display apparatus.

As shown in FIG. 9, the display cassette (including the rear panel 50, the flexible, slatted image display panels and the front window frame 23) are sandwiched in use between a rear drive panel 30 and a front frame portion 31. Driving pins such as pins 32,33 on the drive unit 30 locate into holes 14, 15 and 8 and through the slots on the remaining panels of the cassette to enable the driven panels to be so driven. The cassette is also located by location pins protruding from rear drive and 30 through hole 19. Thus, it is an easy matter to remove and replace a cassette. The front and back panels may be hinged together so that the front hingeably opens to insert or remove a cassette. Other configurations may be used.

Figure 10A:
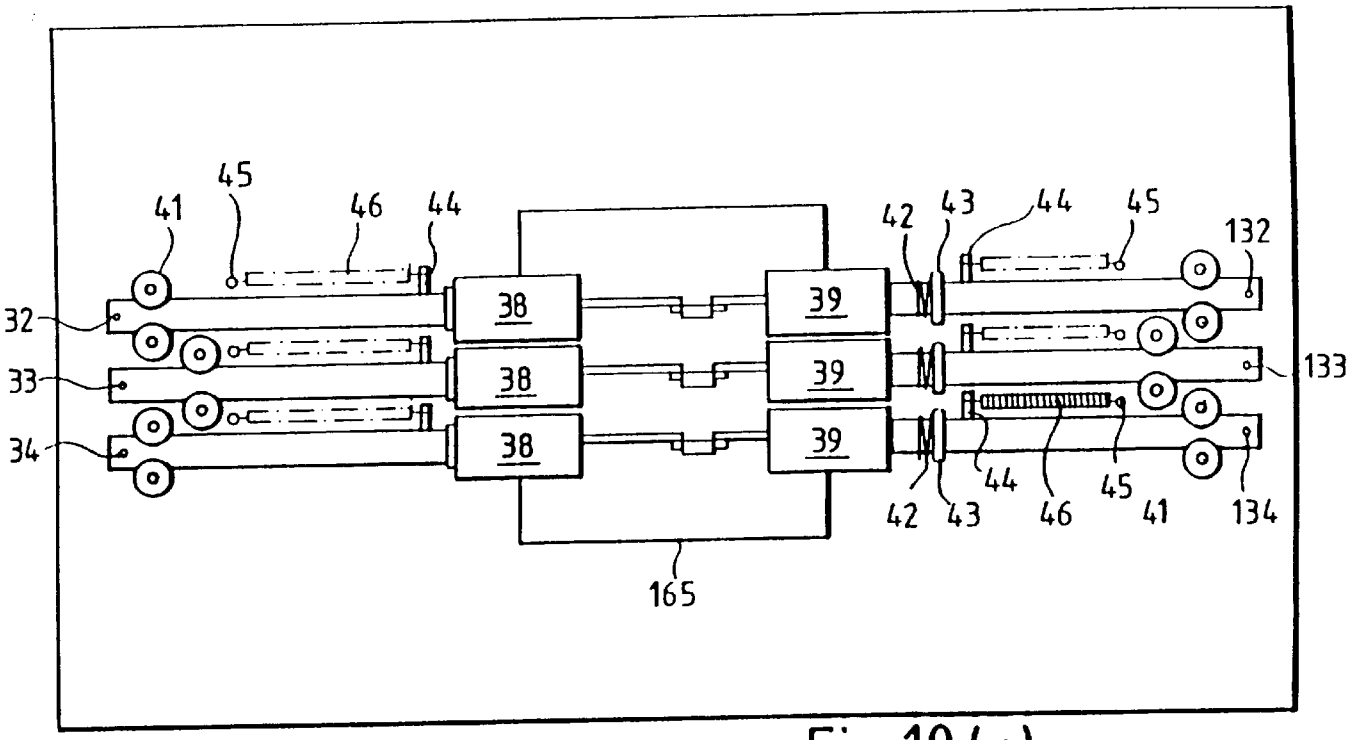
FIG. 10 shows at (a), (b) and (c) respective top, side and front views of a driving mechanism.
Figure 10C:
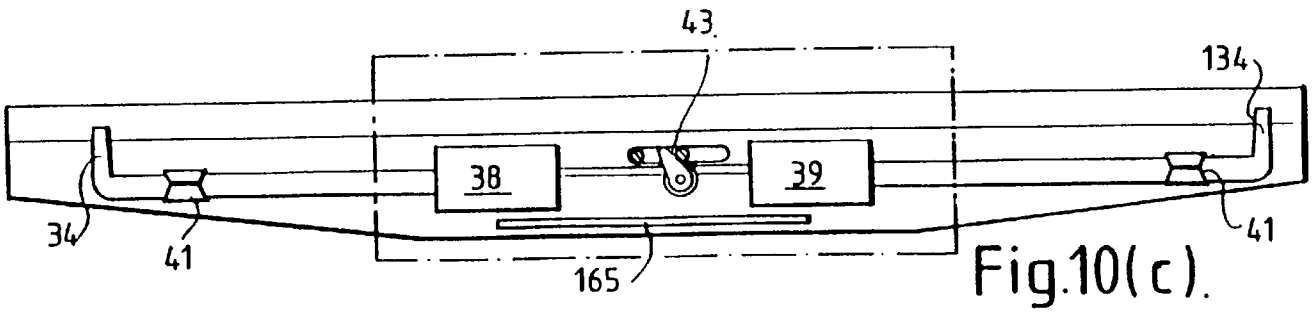
Figure 10B:
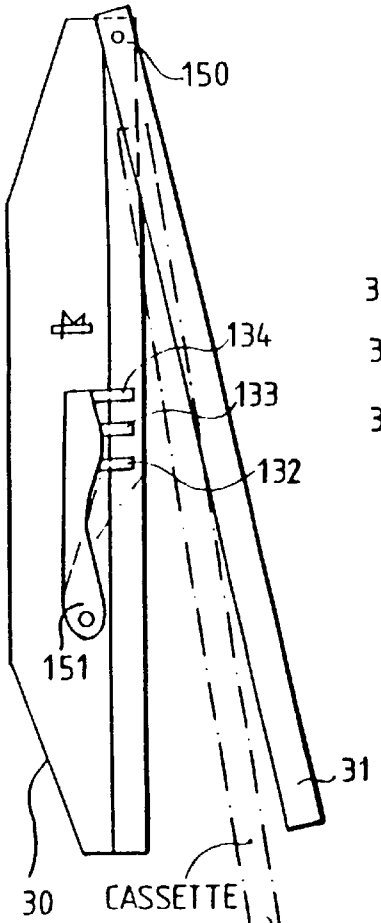

FIG. 10(*a*) shows a drive mechanism.

Driving is achieved by respective pins 32, 33, 34, 132, 133, 134 which act upon holes 14, 15 and 8 in lines 1, 2 and 3 to move these layers sidewardly. Each pair of pins acts upon a particular layer to move this layer relatively to the other layer. Each associated pair of pins, e.g. 32 and 132 is powered by a drive means connected to two magnetically latched solenoids 38 and 39. Other types of drive means may of course be used. Pin 32 is connected by a rod to solenoid 38 and pin 132 is connected by a rod to solenoid 39. The drives from the solenoid are linked to thereby connect pins 32 and 132 together to thereby shift the pins together. The mechanism of the solenoids is described further below. When solenoid 33 drives rod 37 to the left in the figure then 32 moves its respective flexible image layer leftwardly. Rod 40 is also drawn to the left and thereby pin 132 also moves leftwardly. When solenoid 39 is actuated it drives rod 40 and thereby pin 132 to the right and brings with it rod 37 and pine 32. Similarly, pins 33, 133 and pins 34, 134 are driven by respective solenoid pairs at different times determined by a timing circuit to move the other layers. Timing circuits are well known and will not be described further.

In an alternative embodiment, the solenoids may be remote from the apparatus and connected by, for example, a cable.

Each of the rods such as 37 and 40 are guided by a plurality of rollers 41. The movement of the respective pins is limited by springs 42 and plates 43 to ensure that their movement stops before the end of a rod hits the end of the solenoid, to reduce noise and avoid the clunk that would otherwise occur as the rod hits the back of the solenoid at speed. Furthermore, dampers are preferably provided (as shown in FIG. 10(*c*) and in more detail in FIG. 11). Additionally, a protrusion 44 on each one of the respective rods is connected to a fixed point 45 by a spring 46. Thus, the spring connected to each of an opposing pair of rods, such as rods 37 and 40 oppose one another. These springs act as counterbalances when the cassette is used in portrait mode to counter gravitational forces.

FIG. 10(*c*) shows a side view of FIG. 10(*a*) to illustrate the driving mechanism in a little more detail and FIG. 10(*b*) shows a front view.

Referring to FIG. 10(*b*) an embodiment is shown in which a front panel of the apparatus 31 is connected to back panel 30 by a hinge 50. A cassette 53 is shown in dashed lines as partially emerging from the frame. In order to assist in detaching the cassette when the assembly is opened, a cassette detaching member 151 as shown in FIG. 10(*a*) is at a portion which extends under the cassette assembly and an enlarged end portion, having apertures to accommodate the driving pins and which rests underneath the top part of the assembly 31 at a position where this extends beyond the extent of the cassette. The member is hinged 151 and biased so that as top part 31 is lifted upwards member 151 moves from its base position shown in solid lines in FIG. 10(*b*) to its upper position shown in dashed lines. This in turn pushes upon the cassette 53 and causes it to disengage from the pins and to be pushed up a sufficient distance so that it can easily be manually removed. Member 151 also therefore acts to protect the driving pins when a cassette is removed. A mechanism 151 is preferably present at each end of the assembly to protect both sets of pins.

Figure 11:
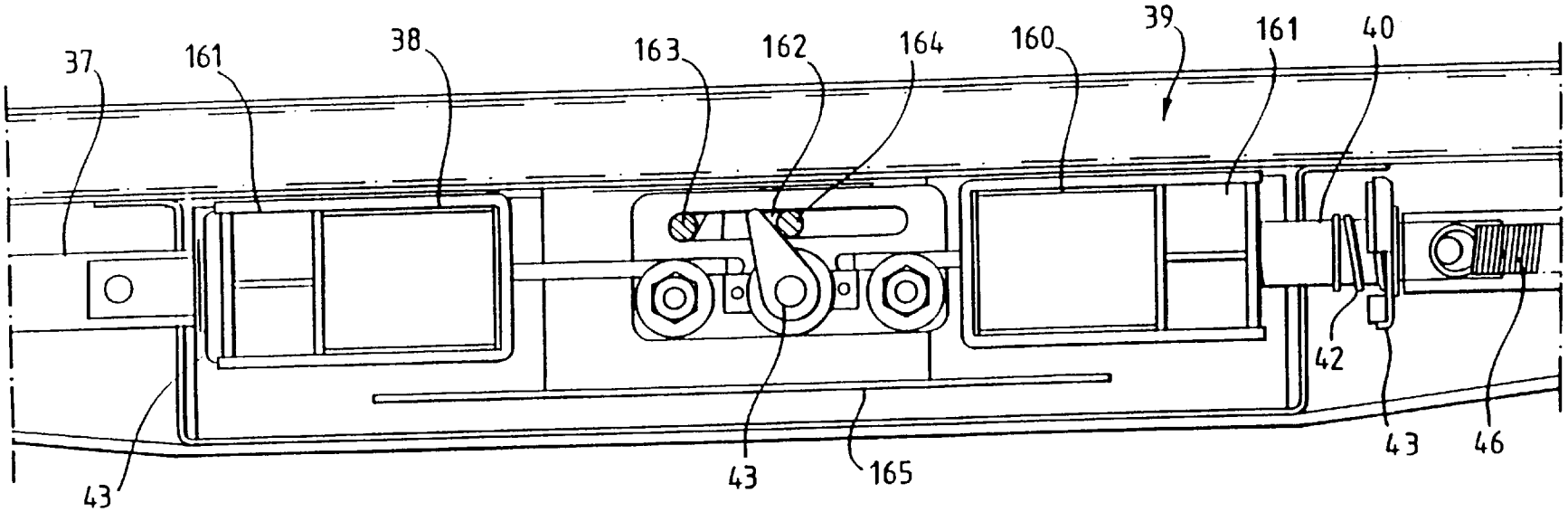
FIG. 11 shows an enlarged detail of part of FIG. 10(*c*)

FIG. 11 shows an enlarged part of FIG. 10(*c*). The magnetically latched solenoid assembly for each rod comprises a solenoid 160 and a permanent magnetic 161. The rod 40 extends through permanent magnetic 161 and coil 160. The situation shown in FIG. 11 is when the right hand solenoid is energized to move rod 40 to the right. Since the other solenoid 38 is deenergised, the rod on this side is pulled to the right by a combination of the magnetic field of permanent magnetic 161 and the force of solenoid 39, together with the various spring forces. Thus, the stop 43 associated with solenoid 38 is abutted against permanent magnetic 161 in the figure and the spring 42 is not seen since this is surrounded by stop 43. The rods 37 and 40 are connected through a damper 43. This damps the ends of the movement to ensure that the movements, although swift, are smooth and that there is not a sudden jolt at the end of each rods movement. These dampers are similar to those which might be used on, for example, motor drives of video cassette players. Essentially, an oil damped cam 162 is constrained to move between two transverse limiting rods 163 and 164, the cam being acted upon by the ends of rods 37 and 40 and transmitting motion between them. The rods are spaced apart to give the required stroke for each image plate, e.g. 18 or 19 mm. A separate damper is used for each pair of associated rods. FIG. 11 shows, mounted underneath the solenoids and damper assembly, a printed circuit board 165 bearing the circuitry for the system.

It will be appreciated that the mechanism may either be used horizontally (landscape mode), as shown, or may be used vertically (portrait mode) so that the rods and pins move in a generally vertical direction. The springs 46 then act as counterbalances.

A secondary display may be driven through an electronic signal between the master display and the secondary, slave, display. Thus, a secondary slave display may be driven in an alternating sequence so that two, or indeed more, displays may be placed adjacent to each other, back to back or at right angles for example to provide a series of images displayed side by side or adjacently.

The solenoids are actuated by a programmable controller timer, typically a programmable integrated circuit, such as a microprocessor, which can actuate each solenoid independently to control the time at which each panel is moved backwards and then forwards. In one embodiment, the timing may be actuated by two adjacent micro switches or other switching devices. These are shown at 166 in FIG. 10(*a*). A combination of different timing selections can be made corresponding to which micro switches is actuated. Each layer of the cassette, except one layer (typically the static image layer), is then provided with two holes or slots in register with the switches through which the microswitches can protrude. The remaining layer (e.g. the static layer) is used to 'program' the microswitch circuit by either having one, two or no holes 167 (FIG. 3). If two holes are present in this layer then no microswitch is set. If one hole is present then a respective corresponding microswitch is set and if two holes are present then both microswitches are set. Timing programs can be pre-programmed which are different for each combination. Thus, a cassette can be pre-programmed to be associated with a certain timing program. A second cassette might be associated with a different timing program and insertion of that cassette automatically sets up the timing program. This has a significant advantage that each cassette automatically sets up its own timing program and no additional user input or programming is required. Alternative methods of achieving this will be apparent. More combinations may be achieved by providing more switching and hole/slots.

FIGS. 12 and 13 illustrate the various time periods above graphically. Layer 1 for instance is exposed for its image to be viewed over time period $T_1$. The solid marks indicate when the various solenoids (Solenoid 1 . . . Solenoid 6) driving the panels are actuated. Layer 2 is exposed during period $T_2$ and layer 3 is exposed during period $T_3$ and during period $T_4$ the static layer 0 is exposed.

In FIG. 12, four different timing routines are shown, set by the cassette as described above. The example shown in FIG. 13 is one of these timing routines. In mode A no timing holes are provided in layer 0. The units of FIG. 12 are seconds.

The hollow marks of FIG. 3 indicate when the solenoids of an optional slave display are actuated, to enable more than one changeable display to be used and minimise power dissipation.

Advantageously, window panel 23 is provided with a finger portion 7 on its underside, as shown in FIG. 7. This portion is elongate and has one end 75 fixed to (or integral with the panel 23. The remainder of the finger tends to hang from the panel, as shown in FIG. 9. Finger 71 includes a hinge portion 76 between its ends and a downwardly extending portion 77 at its distal end.

Finger 71 acts to ensure that all the panels can have a fixed parking portion from where the display cycle starts, or for use during transit of the cassette. For this purpose, additional slots 73 are provided in the respective display panels 5 and 6, and additional holes 72 and 79 are provided respectively in rear cassette panel 50 and static display panel. The hole in the static display panel is laterally extended as shown. When the panels are interconnected, the distal end of finger 71 drops and protrusion 77 locates within slots or holes 72, 73 and 79, each of which has a laterally extended portion 80 for receiving protrusion 76. This sets the respective positions of the panels and precludes relative movement. It is therefore of particular benefit if the cassette is used vertically (i.e. in a 'portrait' disposition). When the cassette is attached to a frame, and the drive means are actuated a pin 81 connected to the rear frame or drive pushes protrusion 77, and thereby finger 71 into an upward position, thereby pushing protrusion 76 out of slots/holes 72, 73, and 79 to free it therefrom. Lateral movement of panels 5 and 6 is then enabled since pin 81 can slide in slots 73 and 74. When pin 81 is retracted, finger 71 drops resiliently into its 'locking' position, thus locking the panel in a parked position. The finger remains in this position when a cassette is removed for transit. In addition, a further microswitch may be actuated by finger 151 (FIG. 10(*b*)) when a cassette is removed, which energises the solenoids to move all the panels into the park position.

Figure 14:
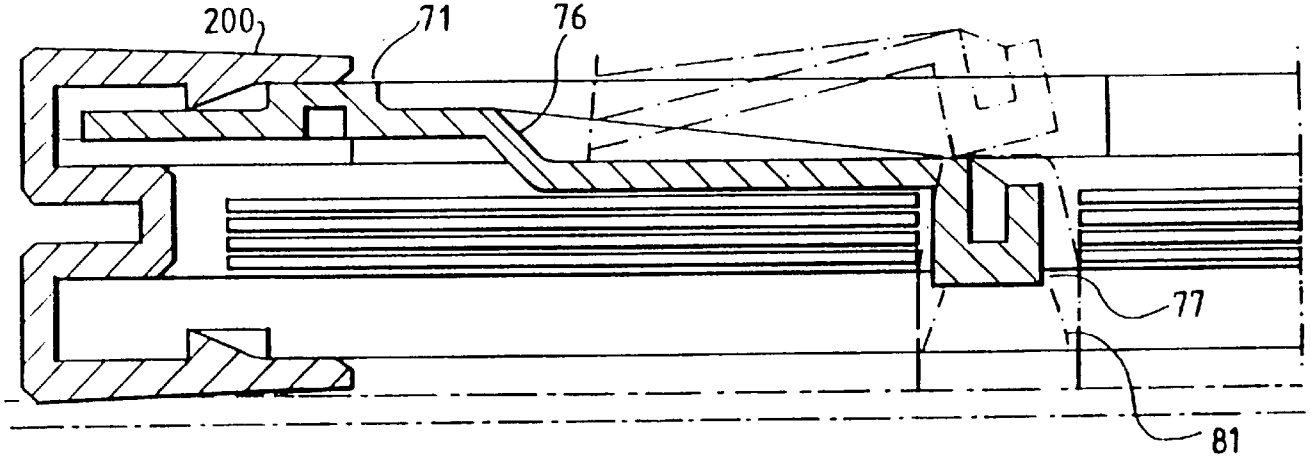
FIG. 14 shows the functioning of a latching finger.
Figure 15:
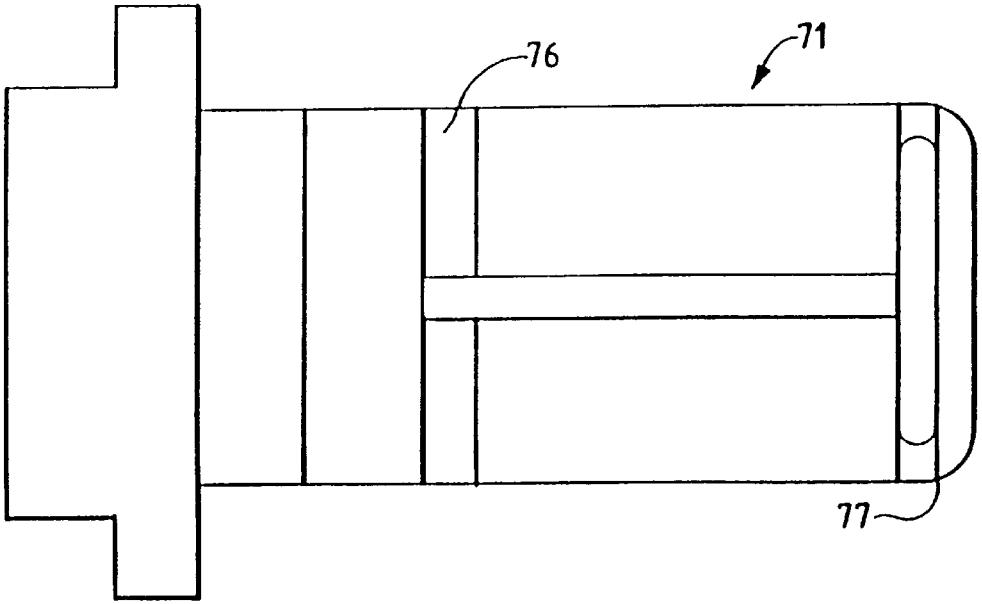
FIG. 15 shows a latching finger.

FIG. 14 also indicates an extrusion 200 joining the edges of the front and back panels of a cassette, and illustrates the image layers sandwiched between them.

Alternatively, the unit may be controlled remotely in order to provide a means of selecting a desired message or advertisement for example during a given period of time.

What is claimed is:

1. A display apparatus comprising:

an interchangeable cassette, the cassette including a front cassette panel, a rear cassette panel which directly engages the front cassette panel and is affixed thereto, a first static image-bearing slatted panel having a plurality of slats, and at least two movable image-bearing slatted panels, having a plurality of slats, each movable panel movable relative to the first static panel, the static panel and the movable panels forming part of the cassette and being positioned between the front cassette panel and the rear cassette panel, and a frame for receiving the cassette, the frame comprising a drive means for selectively moving the movable panels to enable the slats of the movable panels to move from a position behind the slats of the static panel, to a position in front of the slats of the static panel, to thereby enable an image on the movable panels to be viewed, wherein the slats of the static panel are interleaved with the slats of the movable panels.

2. The display apparatus as claimed in claim 1 wherein the drive means are provided on a rear portion of the frame.

3. The display apparatus as claimed in claim 1 wherein the drive means comprises a plurality of drive pins and wherein the movable panels further comprise a plurality of holes and slots, the holes in one of said movable panels being in register with the slots of another of said movable panels so that one of said drive pins can simultaneously enter one of said holes in the one of said movable panels, to move only the one of said movable panels, and move within the slots of the other of said movable panels, so that the other of said movable panels are not moved by the one of said drive pins.

4. The display apparatus as claimed in claim 3 wherein the plurality of holes includes two driving holes towards opposing ends of each of said movable panels, and the plurality of drive pins includes a pair of driving pins for each of said movable panels, wherein each of said driving holes is driven by a respective driving pin, and wherein each of said pair of driving pins is driven by an opposing pair of magnetically latched solenoids in substantially opposite directions.

5. The display apparatus as claimed in claim 4 wherein each of said opposing pair of solenoids is associated with resilient means such that as a solenoid in each said pair is energized to move an associated pin in a direction, another solenoid of said pair is biased by the resilient means to move another associated pin in the same direction.

6. The display apparatus as claimed in claim 3 further comprising at least one resiliently-biased means for partially removing the cassette when the frame is open and simultaneously protecting the drive pins.

7. The display apparatus as claimed in claim 1 wherein each of the slatted panels is a flexible sheet.

8. The display apparatus as claimed in claim 7 wherein the slatted panels are of thickness 200–250 $\mu$m.

9. The display apparatus as claimed in claim 1 further including timing means for actuating the drive means for different panels at predetermined time intervals.

10. The display apparatus as claimed in claim 9 wherein the cassette further comprises means for automatically programming the timing means when the cassette is inserted into the frame.

11. The display apparatus as claimed in claim 1 wherein a movement stroke of at least one of the said movable panels is different from that of the other said movable panels.

12. The display apparatus as claimed in claim 1 wherein the slats of the movable panels partially overlap the slats of the static panel at rest.

13. The display apparatus as claimed in claim 1 wherein movement of the panels is such that a first movable panel moves to reveal an image on the first movable panel, a second movable panel moves substantially behind the first movable panel and the first movable panel then retracts to reveal an image on the second movable panel, these steps being repeated for all the movable panels.

14. The display apparatus as claimed in claim 1 further including counterbalancing means for countering gravity when the apparatus is used in a vertical disposition.

15. The display apparatus according to claim 1 wherein any of the static or movable panels can be selectively removed and replaced.

16. The display apparatus as claimed in claim 1 wherein the cassette is removable from the frame without disassembling the cassette.

17. The display apparatus as claimed in claim 1 wherein the cassette assembly is detachable and reattachable from the drive means of the frame.

18. The display apparatus as claimed in claim 1 wherein the static panel and the movable panels form part of the cassette in which any of the static or movable panels can be selectively removed and replaced.

19. A display apparatus comprising:

an interchangeable cassette, the cassette including a first static image-bearing slatted panel having a plurality of slats, and at least two movable image-bearing slatted panels, having a plurality of slats, each movable panel movable relative to the first static panel, the static panel and the movable panels forming part of the cassette in which any of the static or movable panels can be selectively removed and replaced, a frame for receiving the cassette, the frame comprising a drive means for selectively moving the movable panels to enable the slats of the movable panels to move from a position behind the slats of the static panel, to a position in front of the slats of the static panel, to thereby enable an image on the movable panels to be viewed, and timing means for actuating the drive means for different panels at predetermined time intervals, wherein the slats of the static panel are interleaved with the slats of the movable panels, wherein the cassette further comprises means for automatically programming the timing means when the cassette is inserted into the frame, wherein the programming means comprises the presence or absence of switch actuators on the cassette and a corresponding switch means on the frame connected to the timing means.

20. The display apparatus as claimed in claim 19 wherein the programming means comprises two or more switches and two or more positions where through-holes are selectably present or absent in the cassette to respectively actuate or not actuate the switches, and wherein different settings of the switches correspond to different timing programs.

21. A display apparatus comprising:

an interchangeable cassette, the cassette including a first static image-bearing slatted panel having a plurality of slats, and at least two movable image-bearing slatted panels, having a plurality of slats, each movable panel movable relative to the first static panel, the static panel and the movable panels forming part of the cassette in which any of the static or movable panels can be selectively removed and replaced, and a frame for receiving the cassette, the frame comprising a drive means for selectively moving the movable panels to enable the slats of the movable panels to move from a position behind the slats of the static panel, to a position in front of the slats of the static panel, to thereby enable an image on the movable panels to be viewed, wherein the slats of the static panel are interleaved with the slats of the movable panels, wherein the cassette further comprises a latching means for latching the panels of the cassette when parked or when the cassette is removed from the frame, the latching means comprising a latching element which is moved out of a latching position, against a resilient return force, by a part of the frame when the cassette is inserted, but resiliently returns to the latching position when the cassette is removed.

22. The display apparatus as claimed in claim 21 wherein the latching element is a resilient finger, movable in a series of registered slots in the panels.

23. A display apparatus comprising:

an interchangeable cassette, the cassette including a first static image-bearing slatted panel, having a plurality of slats, and at least two movable image-bearing slatted panels having a plurality of slats, each movable panel movable relative to the first static panel, and a frame for receiving the cassette, the frame comprising a drive means for selectively moving the movable panels to enable the slats of the movable panels to move from a position behind the slats of the static panel, to a position in front of the slats of the static panel, to thereby enable an image on the movable panels to be viewed, wherein the slats of the static panel are interleaved with the slats of the movable panels, wherein the drive means comprises a plurality of drive pins and wherein the movable panels further comprise a plurality of holes and slots, the holes in one of said movable panels being in register with the slots of another of said movable panels, so that one of said drive pins can simultaneously enter one of said holes in the one of said movable panels, to move only the one of said movable panels, and move within the slots of the other of said movable panels, so that the other of said movable panels are not moved by the one of said drive pins, wherein the plurality of holes includes two driving holes towards opposing ends of each of said movable panels, and the plurality of drive pins includes a pair of driving pins for each of said movable panels, wherein each of said driving holes is driven by a respective driving pin, and wherein each of said pair of driving pins is driven by an opposing pair of magnetically latched solenoids in substantially opposite directions, and wherein each of said opposing pair of solenoids is associated with resilient means such that as a solenoid in each said pair is energized to move an associated pin in a direction, another solenoid of said pair is biased by the resilient means to move another associated pin in the same direction.

24. The display apparatus of claim 23, wherein each of the slatted panels is a flexible sheet.

25. The display apparatus of claim 24 wherein the slatted panels are of thickness 200–250 $\mu$m.

26. A display apparatus comprising:

an interchangeable cassette, the cassette including a first static image-bearing slatted panel, having a plurality of slats, and at least two movable image-bearing slatted panels, having a plurality of slats, each movable panel movable relative to the first static panel, and a frame for receiving the cassette, the frame comprising a drive means for selectively moving the movable panels to enable the slats of the movable panels to move from a position behind the slats of the static panel, to a position in front of the slats of the static panel, to thereby enable an image on the movable panels to be viewed, wherein the slats of the static panel are interleaved with the slats of the movable panels, wherein the drive means comprises a plurality of drive pins and wherein the movable panels further comprise a plurality of holes and slots, the holes in one of said movable panels being in register with the slots of another of said movable panels, so that one of said drive pins can simultaneously enter one of said holes in the one of said movable panels, to move only the one of said movable panels, and move within the slots of the other of said movable panels, so that the other of said movable panels are not moved by the one of said drive pins, wherein the display apparatus further includes at least one resiliently-biased means for partially removing the cassette when the frame is open and simultaneously protecting the drive pins.

* * * * *